United States Patent [19]

Goto

[11] Patent Number: 4,514,221

[45] Date of Patent: Apr. 30, 1985

[54] METHOD OF SMELTING ZINC BY INJECTION SMELTING

[75] Inventor: Sakichi Goto, Tokyo, Japan

[73] Assignee: The Japan Mining Promotive Foundation, Tokyo, Japan

[21] Appl. No.: 467,669

[22] Filed: Feb. 18, 1983

[51] Int. Cl.[3] ..... C22B 19/04

[52] U.S. Cl. ..... 75/63; 75/14; 75/72; 75/83; 75/88

[58] Field of Search ..... 75/14, 88, 63, 83, 72

[56] References Cited

U.S. PATENT DOCUMENTS 4,072,503 2/1978 Petterson ..... 75/88
4,141,721 2/1979 Frolov et al. ..... 75/14
4,372,780 2/1983 Madelin ..... 75/88
4,416,692 11/1983 Burch ..... 75/63

*Primary Examiner*—M. J. Andrews

[57] ABSTRACT

A method of recovering metallic zinc is disclosed, wherein zinc calcine is introduced to a smelter together with oxygen-enriched air and pulverized coke or coal as reducing agents. The smelter contains two layers, i.e. an upper layer of slag containing the zinc calcine and a lower layer of crude lead for capturing valuable metals such as gold, silver and copper. Zinc vapor from the smelter is passed to a condenser providing a spray of molten lead or zinc for condensing metallic zinc, from which it is recovered. Effluent gases of high caloric content are also recovered.

4 Claims, 2 Drawing Figures

METHOD OF SMELTING ZINC BY INJECTION SMELTING

BACKGROUND OF THE INVENTION

The methods of zinc extraction can be divided into two main classes, i.e. the methods of Pyro- and Hydrometallurgy. Electrolytic zinc extraction is processed by hydrometallurgy is accomplished by extracting zinc calcine with sulfuric acid solution and cleaning the extracted solution by a purification process and electrolysing this purified zinc or sulfate solution. Metallic zinc, so called electrolytic zinc is deposited on a cathode.

On the other hand, the method of zinc smelting by pyrometallurgy is called a distillation process and is proceeded by mixing zinc calcine mainly consisting of zinc oxide and a reducing agent and charging them into a retort which is kept at a high temperature. Then, zinc is reduced, vaporized and condensed. The distillation process embodies methods of horizontal distillation, vertical distillation and electro thermic distillation. A smelting method by a blast furnace (I S F process) is utilized as one kind of the pyrometallurgical method. This method, as taught in Japanese Patent No. 194576 (Patent publication Showa 27-No. 4111), explains this kind of smelting method of zinc in a blast furnace. This method has the merit in that zinc and lead are recovered at the same time but has several demerits that is, (1) the charged material must be sintered, (2) exhaust heat from the furnace is difficult to recover and, (3) expensive metallurgical coke is necessary.

To save energy consumption in both hydrometallurgical and pyrometallurgical processing of zinc, many improvements have been made. However, even when applying such improvements to the process of the present invention, the energy saving is low, even less than 10 percent.

The following conditions are necessary for saving energy and cost relating to the method of pyrometallurgical smelting of zinc.

(1) Simple processes and low cost of investment are necessary, (2) Energy sources, such as heavy oil and lump coke which have high energy cost per calorie should be changed to coke breeze or pulverized powder coal which are materials of low cost per calorie, (3) The waste energy of exhaust gas or slag should be recovered more effectively;

(4) valuable elements in the zinc calcine should be recovered at high efficiency;

(5) The process should be automatically controlled;

(6) A high production of zinc and effective recovery of by-products from the ore is essential.

Besides these terms, it is obvious that the high production rate of zinc and the effective recovery of the valuable byproducts from the ore are necessary.

Before now, Goto, Ogawa and Takinaka (Abstract Collection of Lectures of the Meeting in Spring of the Japan Mining Society, p. 253, 1979) and H. Abramowitz and Y. K. Rao (Trano Gnst. Min. Met. 87 C180 11978) provide the direct reduction method of the zinc concentrate by CaO and carbon for saving the energy and cost of the pyrometallurgical zinc smelting method but they are not industrialized.

SUMMARY OF INVENTION

It is an object of this invention to provide a zinc smelting method of low total energy cost in connection with the above mentioned pyrometallurgical processes.

Further, it is another object of this invention to develop a series of systems which is able to recover metallic zinc from its ores by a method of low cost using mainly the smelting furnace according to the invention.

The foregoing objects are accomplished by the present invention which provides a method of recovering metallic zinc by smelting a zinc calcine together with a reducing agent, wherein a molten bath which consists of a slag layer having a $Fe/SiO_2$ ratio close to that of the zinc calcine and a crude lead layer existing under the slag layer having been formed previously in a furnace, and the zinc calcine and the reducing agent are injected into the furnace together with oxygen-rich air to contact and mix with the molten bath and the product gas is condensed to recover zinc and lead on the one hand and gold, silver, copper and other valuable metals which are contained in the zinc calcine are retained in the crude lead on the other hand. A coke breeze and/or a pulverized coal are used as the reducing agent in the reducing smelting process and the metal zinc is separated and recovered and waste gas of high calorie content is obtained also in the condensation process by operating together the smelting process and the condensation process.

DETAILED DESCRIPTION

This invention relates to a smelting method in which the zinc calcine is injected into the smelting furnace together with the reducing agent and oxygen-enriched air and zinc vapor generated is condensed and recovered with high efficiency by the condenser which is combined with the smelting furnace, and the content of CO in the waste gas after condensation is so high that the gas can be used effectively as fuel.

Figure 1:
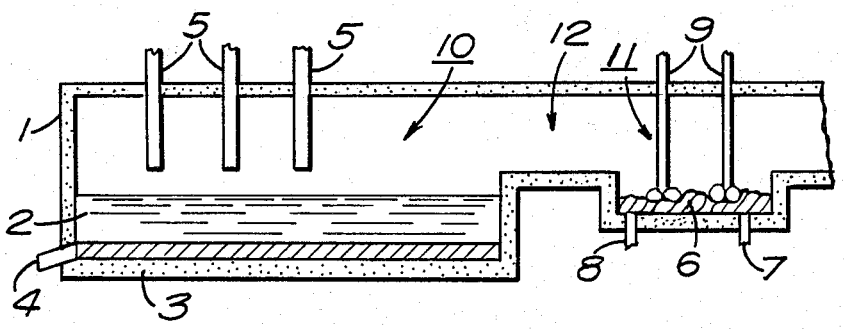
FIG. 1 is a schematic illustration of a smelting furnace embodying the method of the present invention.

Referring now to FIG. 1, a smelting furnace 10 and a condenser 11 are communicably formed in a body 1. A molten bath which consists of a slag layer 2 and a crude lead layer 3 is formed in the smelting furnace and a zinc calcine is blown into the bath together with oxygen-enriched air and a coke breeze (pulverized coke) or pulverized coal through a lance 5 and then gas is generated and introduced into the condenser 11 through the furnace exhaust 12. Metallic zinc in the gas is condensed by a spray of molten lead or zinc 6 which is formed in the condenser 11 by a stirrer 9. Element 4 is a tapping passage, 7 is an inlet passage and 8 is an outlet passage. In the smelting method, a certain amount of the calcine, a reducing agent and air are injected into about 20 t slag which contains about 7% zinc every unit time of operation, for example every two minutes being selected as a unit time, and the equilibrium composition is found assuming that all charged materials reach to the complete equilibrium state. Then, the exact calculation of heat is determined from the equilibrium composition every unit time and the insufficient or the excessive calorie is calculated. The equilibrium calculation is performed according to the model developed by the inventor (S. Goto: Copper Metallurgy. Practice and Theory. Inst. Min. Met 1975, Sakichi Goto: The first symposium of Non-ferrous Mettalurgy, 69th. committee meeting of the Japan Society of Science Promotion 1976).

Then, the product gases are removed completely every unit time and a certain amount of the calcine, coke and air are introduced again and the equilibrium calculation and the exact calculation of heat are repeated concerning the charged materials which exist in the furnace during the next unit time.

Therefore, the calcine and zinc and lead which are included in the slag are distributed in the crude lead, slag and gas. The amount which is distributed in the gas is not calculated in the equilibrium calculation at the next unit times. $SiO_2$ and Fe in the calcine are accumulated in the slag with time. Actually, a certain amount of the slag must be removed from the furnace, as it is assumed in the calculation that the slag is accumulated in the furnace.

(1) The conditions assumed in the calculation.

(a) The constituents of each phase are assumed as follows,

The metal layer : Pb, Pbs

The slag layer : FeO, ZnO, PbO, $Fe_3O_4$, $SiO_2$

The gas layer : PbS, $N_2$, CO, $H_2$, $CO_2$, PbO, Zn, $H_2O$, $O_2$, Pb, $S_2$, $SO_2$.

(b) The free energy change of formation $\Delta G°$, the enthalpy change $\Delta H°298$ and the specific heat Cp° of each constituent which are necessary for the equilibrium calculation adopt the same values as used in the ordinary smelting furnace and the converter (Sakichi Goto: Journal of the Min. Met. Inst. Japan, 95, 1097, P 417(1979)). The activity coefficient $\gamma$ of each constituent of the metal layer and the slag layer is shown in Table 1.

TABLE 1

| | Activity coefficient of each constituent | | | | | |
|---|---|---|---|---|---|---|
| | Metal Layer | | Slag layer | | | |
| | Pb | PbS | FeO | ZnO | PbO | $Fe_3O_4$ |
| $\gamma$ | 1 | 0.1 | 0.3 | 1.2 | 0.063* | 0.5 |

*value at 1150° C., 0.07 at 1,200° C.

(c) The volume and the composition of the slag, the crude lead, the calcine and the coke breeze are same shown in the practical example of the invention.

(d) The volume of air per unit time as follows:

| | |
|---|---|
| $O_2$: 2 $Nm^3$ | $N_2$: 8 $Nm^3$ |

(e) Gram. atom number ($\times 10^4$) of all the elements charged in the furnace is as follows:

| S | Pb | Fe | Zn | O | N | C | H | $SiO_2$ |
|---|---|---|---|---|---|---|---|---|
| 0.0704 | 0.523 | 13.92 | 2.02 | 16.03 | 0.0714 | 0.0361 | 0.00377 | 12.09 |

(2) The results of the equilibrium calculation

The results of the equilibrium calculation at 1150° C. are shown in Table 2. The results show that the concentration of Zn is high as 20%, CO is 36% and $CO_2$ is 2.8%. It shows that the smelting method of the invention is quite possible to commercialize.

(3) The accurate calculation of heat

Assuming that the heat loss from the furnace occurs only by radiation and that the surface area of the outside shell of the furnace is 40.2 $m^2$, the temperature of its surface is constant at 200° C. and the cross-sectional area of an outlet passing from the furnace to the condenser is 1.57 $m^2$, the heat radiated from the furnace is as follows:

$$Q = 0.10\left(\frac{T}{100}\right)^4 + 1.300 \text{ Kcal/min.}$$

where T is the temperature (°K) of the slag. Further, the coefficient of radiation is assumed to be $\epsilon = 0.8$.

The reaction heat, sensible heat and the heat of mixing are calculated from the composition and the amount of the slag, gases and the metal which are found by the equilibrium calculation and then an accurate calculation of heat in a unit time is determined. In this case, the unit time is calculated as 2 minutes. Table 3 shows the results of the calculation.

(4) The calculation in the long time operation

The calculation as the above mentioned same calculation is carried out in the continuous operation of 18 unit times (i.e. operation for 36 minutes at unit times of 2 minutes each). Table 4 shows the results.

The results show that the amount of zinc in the calcine charged is nearly the same as that of the vaporized zinc. The amount used of the cokes is small such as 403 kg per 1 ton of the vaporized zinc, but also the reaction heat is small. The electric power of 17.9 K Wh/min. (2,890 K Wh/t Zn) is necessary to maintain the temperature of the furnace at 1.150° C. when insufficient heat is complemented by electric heat with the electrode inserted in the slag. Now, assuming that the energy of electric power generation per 1 K Wh necessitates 2,550 Kcal, the total energy to be used becomes $10.2 \times 10^6$ Kcal/t Zn (gas). But the energy of the waste gases after the condensation of zinc has a high value of 1,470 Kcal/$Nm^3$, so the energy of 780 K Wh/t Zn(g) calculated in terms of the amount of the electric power is recovered. Therefore, the total energy used is $8.2 \times 10^6$ Kcal/t Zn(gas) when the energy recovered is subtracted. It is understood that a method of zinc smelting which consumes less energy than $(9-11) \times 10^6$ Kcal/t Zn of energy unit which is required in the conventional method can be developed.

TABLE 2

(Result of equilibrium calculation)

| | amount produced | | | | |
|---|---|---|---|---|---|
| | t | number of mol[10] | molar fraction | Wt % | coefficient activity |
| metal phase | 0.99 | 0.467 | — | — | — |
| Pb | — | 0.397 | 0.849 | 83.0 | 1.0 |
| PbS | — | 0.0704 | 0.151 | 17.0 | 0.1 |
| slag phase | 19.02 | 28.04 | — | — | — |
| FeO | — | 13.87 | 0.495 | 52.4 | 0.3 |
| ZnO | — | 2.00 | 0.072 | 8.58 | 1.2 |
| PbO | — | 0.055 | 0.00197 | 0.65 | 0.063 |
| $Fe_3O_4$ | — | 0.017 | $6.1 \times 10^{-4}$ | 0.21 | 0.5 |
| $SiO_2$ | — | 12.09 | 0.431 | 38.2 | 2.23 |
| gas phase | — | 0.0933 | — | — | — |
| PbS | — | $5.4 \times 10^{-5}$ | $5.8 \times 10^{-4}$ | — | — |
| $N_2$ | — | 0.0357 | 0.383 | — | — |
| CO | — | 0.0335 | 0.359 | — | — |
| $H_2$ | — | $1.6 \times 10^{-3}$ | 0.017 | — | — |
| $CO_2$ | — | $2.6 \times 10^{-3}$ | 0.0283 | — | — |
| PbO | — | $3.8 \times 10^{-7}$ | $4.1 \times 10^{-6}$ | — | — |
| Zn | — | 0.0187 | 0.200 | — | — |
| $H_2O$ | — | $2.8 \times 10^{-4}$ | $3.04 \times 10^{-3}$ | — | — |
| $O_2$ | — | $1.3 \times 10^{-15}$ | $1.3 \times 10^{-14}$ | — | — |
| Pb | — | $9.1 \times 10^{-4}$ | $9.7 \times 10^{-3}$ | — | — |

TABLE 2-continued (Result of equilibrium calculation)

| | | | | | |
|---|---|---|---|---|---|
| $S_2$ | — | $1.8 \times 10^{-8}$ | $1.9 \times 10^{-7}$ | — | — |
| $SO_2$ | — | $1.8 \times 10^{-9}$ | $1.9 \times 10^{-8}$ | — | — |
| | S | Pb | Fe | Zn | O wt % |
| metal | 2.28 | 97.7 | — | — | 13.5 |
| slag | — | 0.60 | 40.9 | 6.89 | |

TABLE 3

(accurate calculation of heat)

| input | $10^6$ Kcal | output | $10^6$ Kcal |
|---|---|---|---|
| heat of reaction | 10.55 | decomposition heat of calcine and coke | 0.0183 |
| sensible and latent heat of crude lead, slag and furnace body before the reaction | 19.06 | sensible and latent heat of crude lead, slag, furnace body & gas | 29.61 |
| (the value is deducted the heat of decomposition of elements) | | (calorie carried away by gas thereof | 0.0183) |
| insufficient heat | 0.0307 | heat of radiation | 0.0108 |
| total | 29.64 | total | 29.64 |

TABLE 4

(calculation of the long time operation)

| | number of times calculated | | | | |
|---|---|---|---|---|---|
| | 1 | 5 | 10 | 15 | 18 |
| crude lead t | 0.99 | 1.00 | 1.02 | 1.04 | 1.04 |
| Pb wt % | 97.7 | 97.7 | 97.7 | 97.6 | 97.6 |
| S wt % | 2.3 | 2.3 | 2.3 | 2.4 | 2.4 |
| slag t | 19.02 | 19.03 | 19.05 | 19.06 | 19.07 |
| Pb wt % | 0.60 | 0.59 | 0.59 | 0.59 | 0.58 |
| Zn wt % | 6.89 | 6.88 | 6.87 | 6.85 | 6.85 |
| Fe wt % | 40.9 | 40.9 | 40.9 | 40.9 | 40.9 |
| $SiO_2$ | 38.2 | 38.2 | 38.2 | 38.2 | 38.3 |
| gas mol | 933 | 936 | 937 | 937 | 937 |
| Zn % | 20.0 | 20.2 | 20.3 | 20.3 | 20.3 |
| CO % | 35.9 | 35.8 | 35.8 | 35.8 | 35.8 |
| $CO_2$ % | 2.83 | 2.79 | 2.78 | 2.77 | 2.76 |
| $O_2$ % | $1.3 \times 10^{-12}$ | $1.3 \times 10^{-12}$ | $1.3 \times 10^{-12}$ | $1.3 \times 10^{-12}$ | $1.3 \times 10^{-12}$ |

| | |
|---|---|
| Total calcine charged | 423 Kg (include Zn 218 Kg, Pb 86.7 kg) |
| Total cokes charged | 90 Kg |
| Total amount of zinc vaporized | 223 Kg (102% to zinc of charged ore) |
| Total amount of lead vaporized | 35.7 kg (41% to lead of charged ore) |
| Insufficient heat | $5.54 \times 10^5$ Kcal (= 645*K wh), 2.890 K Wh/t Zn(g). 17.9 K Wh/min |
| Total energy used | $10.2 \times 10^6$ **Kcal/t Zn(g) |
| Total amount of gases produced | 16,860 mol (378 $Nm^3$), 1,690 $Nm^3$/t Zn(g) |
| sensible heat of total amount of gases produced | $2.3 \times 10^5$ Kcal, $1.03 \times 10^6$ Kcal/t Zn(g) |
| Calorie of gas after condensation of zinc | 1,470 Kcal/$Nm^3$ |

*calculated as 1 K Wh = 860 Kcal
**2,550 Kcal per 1 K Wh electric power

As demonstrated above, the invention has resulted in valuable information after searching for the input and output of the substances and the composition which reached the equilibrium state, and then calculating accurately the amount of heat from the equilibrium composition as well as calculating the input and output heat and repeating these processes theoretically to develop a new method of smelting.

Based on the results of the above-mentioned heat equilibrium, the invention developed the method as follows:

(i) The molten bath consists of 2 phases, i.e., the slag phase which has the composition of nearly the same $Fe/SiO_2$ ratio as that of the zinc calcine and the crude lead phase which is placed under the slag phase.

(ii) The coke breeze or the pulverized coal is used as the reducing agent and fuel and also the oxygen-enriched air is used.

(iii) The smelting process and the condensation process are combined in the furnace.

Thus, the invention solved the problems of the conventional methods by developing a smelting method which can save energy and cost.

Referring again to FIG. 1 which is a schematic illustration of the smelting furnace embodying the method of the present invention, the smelting furnace 10 and the condenser 11 are established in a body 1. The smelting furnace 10 is the shape of half cylinder and it may be made from any fire-resistant materials which can easily reach the heat equilibrium state, but chrome-magnesia brick is preferable from the viewpoint of the degree of fire- and heat-resistance. The amount of the molten fayalite slag layer 2 must exist in some quantity for maintaining a buffer action against the change of the charged amount, thereby minimizing the generation of dust and lengthening the contact time among the calcine, the reducing agent, air and the slag. Further, the composition of the slag which is charged and heated previously is preferably to be nearly the same $Fe/SiO_2$ ratio as that of the calcine which is injected, although the viscosity of the slag has the tendency to increase according to the increase of the content of $SiO_2$.

Further, CaO may be added as a flux in consideration of the CaO content of the calcine and the melting point of the slag. The crude lead layer 3 is useful for capturing gold, silver, copper and other valuable substances in the concentrate must be thick enough to capture the valuable substances, preferably 5–10 wt % of the slag. The gold, silver, copper and lead which are captured in the pool of the crude lead are discharged suitably from a tapping hole 4. The time of discharging the crude lead is decided by measuring the height of the pool of the crude lead. The valuable metals in the crude lead are recovered respectively by ordinary methods. The burned zinc ore, preferably a hot calcine immediately after roasted air, preferably oxygen-enriched air which contains above 30% oxygen, fuel and the reducing agent, for instance low cost coke breeze or pulverized coal is injected into the furnace through a lance 5. The lance 5 which injects the calcine, air and the reducing agent into furnace is the most important to accomplish the method of the invention and it may be directly immersed in the slag phase. The important point is that the calcine is melted as soon as possible in the slag phase at 1100°–1350° C. and the reducing agent and air are injected to contact well with the slag. The material of the lance is preferably heat and wear resistant at the temperature of 1100°–1350° C.

An auxiliary electrode for heating may be installed in contact with the slag layer 2 in the smelting furnace 10 to maintain the slag phase at the prescribed temperature at the beginning of the smelting and during the operation. The condenser 11 which is formed in combination with the smelting furnace 10 holds the pool 6 of the molten lead or the molten zinc on its bottom and an inlet 7 and an outlet hole 8 are installed for circulating the pool 6 and a stirrer 9 with a blade is installed in the pool 6. The smelting furnace 10 is connected with the condenser 11 by a connecting hole 12 in the furnace.

As a condenser the splash condenser for lead which is revealed, for instance, in Japan patent publication Showa 29-No. 7001 or Japan patent publication Showa 47-No. 15587 may be used when the concentration of zinc in the produced gas is high.

The calcine obtained by roasting zinc concentrate is preferably used in the heated state immediately after roasting and is injected into the molten bath of the above-mentioned furnace heated at about 1200°–1300° C. through the lance 5 together with the oxygen-enriched air and the coke breeze or the pulverized coal as the reducing agent and fuel and the smelting is conducted. The gas is generated in the smelting furnace by the smelting. The generated gases consists of Zn, CO, $CO_2$, $H_2$, $H_2O$, Pb, PbS, $S_2$, $SO_2$ and $N_2$. The composition of the generated gases is Zn 7–16%, CO 40–75%, $CO_2$ 8–15% when the oxygen-enriched air having a concentration of oxygen of more than 40 vol % is used according to the invention. The concentration of zinc thus obtained is higher than that obtained by using ordinary air and the exhaust gas after condensation of metal has a concentration of CO of high calorie content. The gas from the furnace is introduced into the condenser 11 and the zinc vapor is captured in pool 6 of the condenser 11. Zinc which is condensed and recovered in the pool 6 of the molten lead or the molten zinc is recovered by tapping the metal from the bottom of the condenser. The temperature of the lead is 500°–650° C. in the condensation operation and the produced gas is quenched rapidly in the lead and the temperature of the gas is about 550° C. at the outlet of the condenser 11. The calorie value of the waste gases which are generated in conventional furnace for zinc smelting is 500°–800 Kcal/$Nm^3$, whereas the exhaust gas of the present invention has such higher calorie value than those of the conventional ISP method that it can be used effectively in a power generating plant.

It is necessary that the iron in the slag is not reduced so that the reaction in the smelting apparatus 10 is carried smoothly since reduction to metallic iron creates difficulties.

Further, the zinc is condensed and recovered by the splash condenser for lead as above mentioned or by the splash condenser for zinc depending on the concentration of zinc to prevent the reoxidation of zinc in the equilibrium reaction of $ZnO+CO \rightleftarrows Zn+CO_2$.

Figure 2:
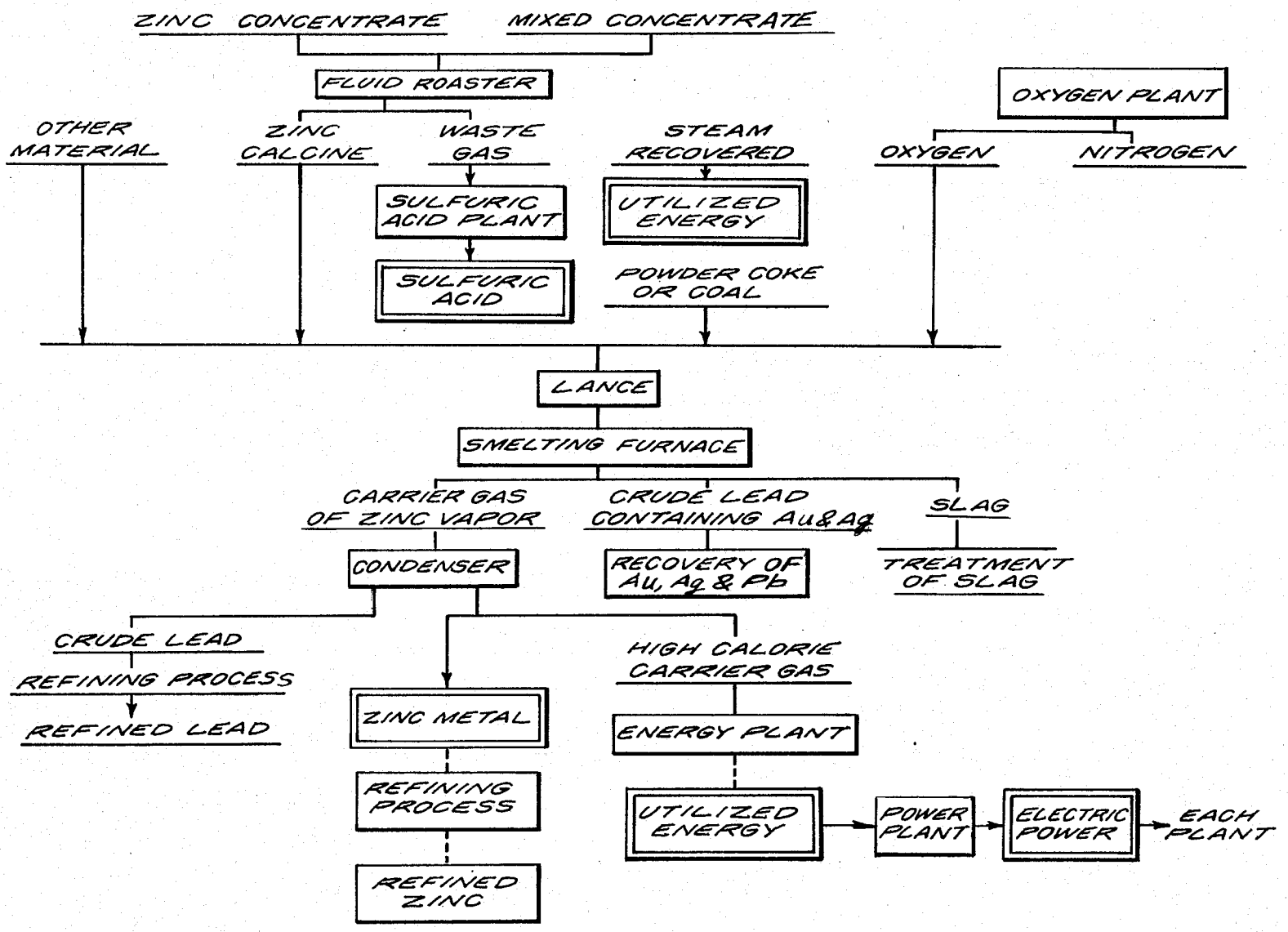
FIG. 2 is a process flow sheet of the method of zinc smelting embodying the present invention.

Next, one example of a continuous flow system in the present method of zinc smelting using the above-mentioned smelting furnace is shown in FIG. 2.

EXAMPLES

The examples of the invention are shown hereinafter. The structure indicated in FIG. 1 was used as the smelting furnace in each example.

The size of the furnace is as follows:

| | |
|---|---|
| an outside shape - a half cylinder, Material - a lining of chrome magnesia brick | |
| an outside diameter - 2m, a length - 5.9m, area of the surface 40.2$m^2$ | |
| the slag phase - about 19t (contains about 7% 2n) | the temperature of the molten bath is 1200° C. |
| the crude lead phase - about 1t | |

EXAMPLE 1 AND EXAMPLE 2

The zinc calcine and the coke breeze are injected into the above-mentioned furnace through the upper lance together with the oxygen-enriched air and the zinc is reduced and smelted and recovered in the circulating lead in the lead splash condenser.

Where Example 1 is the case of 50% oxygen concentration in the air.

Example 2 is the case of 98.4% oxygen concentration.

The amount and the composition of the crude lead and the slag in the smelting furnace before starting the injection are as follows:

The composition is indicated by wt %.

| | Amount (t) | S | Pb | Fe | Zn | $SiO_2$ | $Fe/SiO_2$ |
|---|---|---|---|---|---|---|---|
| Crude lead | 0.98 | 2.27 | 97.73 | — | — | — | — |
| Slag | 19.0 | — | 0.61 | 40.9 | 6.89 | 38.2 | 1.07 |

The amount and the composition of the calcine charged are as follows:

| Amount kg/h | S | Pb | Fe | Zn | $SiO_2$ | $Fe/SiO_2$ |
|---|---|---|---|---|---|---|
| 3000 | 0.6 | 20.5 | 5.5 | 51.5 | 4.96 | 1.11 |

The charged amount 3000 kg/h mentioned above becomes the amount of 2160 t/month of the treated calcine.

The amount and the composition of the coke breeze is as follows:

| Amount kg/h | S | O | C | H | $SiO_2$ | F-C | volatilized part ($CH_4$) | $H_2O$ |
|---|---|---|---|---|---|---|---|---|
| 2400 | 0.5 | 0.44 | 86.5 | 0.56 | 12.00 | 85 | 2 | 0.5 |

The results of Example 1 and Example 2 are shown together with other conditions of the operation in Table 5.

EXAMPLE 3

This is a case in which the calcine which is obtained by roasting the zinc concentrate having a small content of copper and lead is smelted.

The amount and the composition of the calcine charged and the slag in the smelting furnace are as follows:

The amount and the composition of the calcine charged (wt %)

| Amount kg/h | S | Pb | Cu | Fe | Zn | $SiO_2$ |
|---|---|---|---|---|---|---|
| 3000 | 2.30 | 1.78 | 2.44 | 7.17 | 61.6 | 6.9 |

The amount and the composition of the slag in the smelting furnace (wt %)

| Amount t/h | S | Pb | Fe | Zn | $SiO_2$ |
|---|---|---|---|---|---|
| 20 | 0.5 | 0.5 | 40.0 | 6.05 | 38.0 |

The composition and other conditions of the operation are the same as those of Example 1 and Example 2. The results are indicated in Table 5.

EXAMPLE 4

A chute is equipped at the upper part of the smelting furnace used in Example 1 for charging a lump of coke breeze intermittently. The zinc calcine, the coke breeze and the oxygen-enriched air are simultaneously injected into the slag as described in Example 1 and the lump coke of 10–50 mm is charged from the chute. The lump coke is an amount of about one ton is charged before the operation and a lump coke charged of 125 kg is replenished every 30 minutes thereafter and the thickness of the layer of the lump coke on the slag is maintained at about 20 cm.

Other conditions and the results of the smelting are shown in Table 5.

Example 4 shows the case in which the surface of the slag is covered with the lump coke or coke breeze.

A portion of carbon in the lump coke contacts with ZnO in the slag, and Zn vapor and CO gas are produced by the reaction shown as follows:

$$ZnO + C \rightarrow Zn(g) + CO$$

Also, the carbon reacts with $CO_2$ gas which is produced by the reaction of the materials injected into the slag, and CO is generated by the reaction as follows:

$$C + CO_2 \rightarrow 2CO$$

The inside charge of the furnace becomes reduced by the carbon and COgas, and the content of Zn in the slag is lowered and the amount of a dross produced in the condenser is decreased about $\frac{2}{3}$ as compared with the case in which the slag is not covered with the lump coke or coke breeze, and the rate of recovery of the metal zinc is raised to 91%.

Further, the thicker the layer of coke on the slag, the bigger the seal effect becomes, but there is a limit to the thickness of the layer because the air blown in is obstructed from being introduced into the slag, therefore a thickness of about 50–250 mm is preferable. A size of about 10–50 mm of the lump coke is preferable.

EXAMPLE 5

A shaving powder (iron powder) and a lime stone powder (−100 mesh) are mixed in the calcine and $Fe/SiO_2$ and FeO/CaO ratios in the slag are adjusted to 2.5 and 4.0 respectively and the change in the result of the operation is examined in the same smelting furnace as used in Example 1.

The composition (wt %) of the slag used in this example is as follows:

| | S | Pb | Fe | Zn | $SiO_2$ | CaO |
|---|---|---|---|---|---|---|
| Composition of slag | 0.5 | 0.5 | 43.0 | 6.0 | 22.1 | 14.5 |

Further, the composition of the calcine charged is the same as that of Example 3.

The results of the smelting and other conditions of the operation are shown in Table 5.

TABLE 5

| | | Example of the invention condition of ore | | | | | | |
|---|---|---|---|---|---|---|---|---|
| | | Zinc calcine of more pb | | | Zinc calcine of less Pb | | | |
| | | condition of air | | | | | | |
| | | $O_2$ conc. 50% | $O_2$ conc. 98.4% | $O_2$ conc. 90.9% | $O_2$ conc. 90.9% | $O_2$ conc. 90.9% | | |
| | | examples | | | | | comparative examples | |
| Remarks | unit | No. 1 | No. 2 | No. 3 | No. 4 | No. 5 | No. 6 | No. 7 |
| Condition of the examination | | | | | | | | |
| Temperature of the slag phase | °C. | 1,200 | 1,200 | 1,300 | 1,300 | 1,300 | 1,150 | 1,200 |
| Amount of injected calcine | kg/h | 3,000 | 3,000 | 3,000 | 3,000 | 3,000 | 3,000 | 3,000 |
| Amount of reducing agent used (powder cokes) | " | 2,400 | 2,400 | 1,650 | lump 250 powder 1400 | 1,650 | 3,900 | 2,400 |
| Amount of air | | | | | | | | |
| Amount of $O_2$ | $Nm^3$ min | 32.5 | 30.0 | 22 | 22 | 22 | 1.0 | 35.0 |
| Amount of $N_2$ | " | 32.5 | 0.5 | 2.2 | 2.2 | 2.2 | 4.0 | 140.0 |
| Total | " | 65.0 | 30.5 | 24.2 | 24.2 | 24.2 | 5.0 | 175.0 |
| Amount of $O_2$/t reducing agent | $Nm^3$/t | 813 | 750 | 800 | 800 | 800 | 153 | 875 |
| Temperature of injected calcine | °C. | 800 | 800 | 500 | 500 | 500 | 800 | 800 |
| Result of the examination | | | | | | | | |
| produced gas | | | | | | | | |
| Amount of gas | kg mol/h | 298.8 | 216.3 | 160.8 | 160.8 | 160.8 | 62.3 | 593.1 |
| Zn | vol % | 8.4 | 11.9 | 17.3 | 17.4 | 17.3 | 34.7 | 5.2 |
| Pb | " | 0.54 | 0.5 | — | — | — | 1.0 | 0.4 |
| CO | " | 47.7 | 70.1 | 55.4 | 55.7 | 55.6 | 43.1 | 21.2 |
| $CO_2$ | " | 10.2 | 9.9 | 19.9 | 19.6 | 19.7 | 2.07 | 7.9 |
| produced slag | | | | | | | | |
| Amount of | kg/h | 717 | 720 | 757 | 740 | 1030 | | |

TABLE 5-continued

| | | Example of the invention condition of ore | | | | | | |
|---|---|---|---|---|---|---|---|---|
| | | Zinc calcine of more pb | | Zinc calcine of less Pb | | | | |
| | | condition of air | | | | | | |
| | | $O_2$ conc. 50% | $O_2$ conc. 98.4% | $O_2$ conc. 90.9% | $O_2$ conc. 90.9% | $O_2$ conc. 90.9% | comparative examples | |
| Remarks | unit | No. 1 | No. 2 | No. 3 | No. 4 | No. 5 | No. 6 | No. 7 |
| production | | | | | | | | |
| Zn | wt % | 6.48 | 6.8 | 6.47 | 5.50 | 5.80 | metallic iron is reduced and calorie is insufficient and continuous operation is difficult | efficiency of condensation is fad and Zn metal can not be recovered |
| Pb | " | 1.42 | 1.08 | 0.21 | 0.23 | 0.21 | | |
| Amount of crude lead produced | t/h | 0.28 | 0.40 | — | — | — | | |
| Amount of recovery of condensed Pb | t/h | 0.30 | 0.21 | 0.035 | 0.039 | 0.035 | | |
| Amount of recovery of condensed Zn | t/h | 1.31 | 1.33 | 1.57 | 1.68 | 1.63 | | |
| consumption of reducing agent | t/(Zn + Pb)$_t$ | 1.27 | 1.22 | 1.03 | 0.96 | 1.00 | | |
| Produced gas after condition | | | | | | | | |
| Amount of gas | $Nm^3$/t(An + Pb) | 3340 | 2168 | 1856 | 1733 | 1807 | | |
| calorie of combustion | Kcal/$Nm^3$ | 1720 | 2700 | 2030 | 2050 | 2030 | | |
| Rate of recovery of Zn metal | % | 85 | 86 | 85 | 91 | 88 | | |
| Rate of recovery of Pb metal | % | 90 | 92 | 66 | 73 | 71 | | |
| Total necessary energy | $10^6$ Kcal/t(Zn + Pb) | 9.4 | 8.9 | 7.7 | 7.2 | 7.5 | | |

In Example 5, it is obvious from Table 5 that zinc vaporizes well and the content of zinc in the slag is decreased.

The amount of the slag produced is increased by the amount of the flux added but the viscosity of the slag is lowered and the reactivity of the coke breeze is improved and the rate of the recovery of zinc is raised as compared with Example 3.

EXAMPLE 6

A zinc calcine which contains less lead is used as in Example 3, 4, and 5. A crude lead is charged in the smelting furnace from the outside of the system because the crude lead produced is not enough to be contacted with the slag and the behavior of the valuable metals in the calcine is examined. Namely, the crude lead of 5 ton is melted (about 700° C.) outside the system and charged in the smelting furnace at the rate of 1 ton/hour by the well-known hard lead pump and the same amount/hour is discharged simultaneously from the tapping hole 4 shown in FIG. 1.

This process of smelting is continued for 24 hours and the results are shown in Table 6.

TABLE 6

| | | | Example 6 | |
|---|---|---|---|---|
| | | Example 3 | quality | rate of distribution |
| In the crude lead | Au | almost nothing appeared | Au 0.6 g/t | 82% |
| | Ag | | Ag 140 g/t | 76% |
| | Cu | | Cu 2.0% | 70% |
| In the slag discharged | quality | rate of distribution | | |
| | Au 0.2 g/t | 100% | Au trace | — |
| | Ag 50 g/t | 100% | Ag 12 g/t | 24% |
| | Cu 0.8% | 100% | Cu 0.24% | 30% |

Table 6 shows that the valuable metals, especially Au, Ag and Cu can be recovered efficiently by supplying the crude lead from the outside of the system in the case of insufficient lead as shown in Example 6.

COMPARATIVE EXAMPLE

Comparative examples No. 6 and No. 7 were proceeded by using ordinary air instead of the oxygen-enriched air to compare with the examples of the invention and the results are shown together in Table 5.

The following facts are understood by comparing the examples No. 1–No. 5 of the invention with the comparative examples.

Namely, the results of Example 1 and Example 2 from Table 5 are as follows:

The more the enrichment of oxygen in the air, the less the amount of the gas generated is, therefore the sensible heat carried away becomes less. Especially, in the case of Example 2 wherein air which is nearly pure oxygen is used, the composition of the produced is Zn 11.9%, CO 70% and $CO_2$ 10%, the efficiency of the condensation of zinc is good, and the caloric value of the gas after the condensation is as high as 2700 Kcal/$Nm^3$, and the gas can be utilized efficiently for many purposes.

For instance, the calorie value of the gases can furnish more calories than necessary for the electric power (0.5 KWH/1 $Nm^3O_2$) requirements of an oxygen generating plant and for a refining process for condensed zinc. Further, in the case of Example 3 wherein zinc calcine which contains less lead is injected into the furnace, the total necessary energy becomes less than $7.7\times10^6$ Kcal / ton.

In the case of Comparative example 6 on the other hand, in which lesser amount of the ordinary air is used, the potential of $O_2$ in the produced gas reaches a condition which reduces iron oxide in the slag to metallic iron, the operation becomes difficult to maintain and the amount of zinc in the slag is raised which results in the undesirable lowering of the recovery of zinc.

In the case of Comparative example 7, in which a great amount of air is injected into the furnace, it is difficult to maintain a balance of heat except by reactive heat and the slag must be heated by an electrode to maintain the desired temperature. Moreover, the concentration of zinc in the produced gas becomes low, the concentration of $CO_2$ is high the production of the dross is increased and furthermore the dust of the calcine is found in the carrier gas. For this reason, the rate of condensation of zinc is lowered and the calorie value of the exhaust gases after the condensation is low, so it is difficult to utilize such gases as a source of energy. On the other hand, in the case of Example 3, the lead in the calcine is mostly vaporized in the melting process while a small part of it is captured in the crude lead with Au, Ag, and Cu which exists in the lower part of the furnace, but almost all of the lead in the calcine is recovered in the condensation process.

Finally, as to the rate of consumption of energy, the necessary amount of energy for Examples 1 and 2 is $(8.9\text{–}9.4)\times 10^6$ Kcal/t.

Finally, Example 2 of the invention is compared with conventional methods of electrolytic, electrothermic, ISP and vertical retort, and the results are shown in Table 7. It is obvious from Table 7 that the requirements for energy in the method of the invention is substantially $7.9\times 10^6$ Kcal/t while the energy requirements of conventional methods of electrolytic electrothermic ISP and Vertical retort are substantially 9.4, 11.1, and 11.1 ($\times 10^6$ Kcal/t) respectively.

The consumption of energy can be reduced to about 15–30% by the method of the invention compared with those of the conventional methods.

TABLE 7

| Remarks | Electro-lytic process | Electro-thermic process | ISP | Vertical retort process | Method of the invention | Note |
|---|---|---|---|---|---|---|
| Consumption | | | | | | |
| {Smelting} | | | | | | |
| heavy oil l/t metallic zinc | 51.6 | 43.0 | 18.9 | 12.0 | — | |
| electric power KWh/t | 4000 | 3140 | 491 | 560 | 435 | |
| coke t/t | — | 0.50 | 1.10 | 0.004 | 1.160 | |
| coal t/t | — | — | — | 0.96 | — | |
| gas $Nm^3$/t (COG) | — | — | — | 465 | — | |
| $O_2$ $Nm^3$/t | | | | | 870 | |
| {Refining} | | | | | | |
| yield 98.9% | | | | | | |
| electric power KWh/t | — | 49.3 | 49.3 | 49.3 | 49.3 | |
| gas $Nm^3$/t(ALG) | — | 54.5 | 305 | 305 | 305 | |
| Convert-in energy | | | | | | |
| $\times 10^6$ Kcal/t | | | | | | |
| Smelting } | | 11.9 | 9.0 | 10.7 | 8.93 | 0.5 KWh/$Nm^3$ - $O_2$ |
| Refining } | 10.7 | 0.5 | 2.3 | 2.3 | 2.3 | |
| Oxygen plant | | | | | 0.37 | 1 KWh = 860 Kcal |
| | 10.7 | 12.4 | 11.3 | 13.0 | 11.6 | |
| Recovered energy | | | | | | |
| $\times 10^6$ Kcal/t | | | | | | |
| steam of roaster | Δ1.3 | Δ1.3 | — | Δ1.3 | Δ1.3 | |
| Necessary energy of | — | — | Δ1.2 | — | — | |
| Pb smelting | | | | Δ0.6 | Δ2.16 | |
| Home plant by waste heat recovery heat of hot calcine | | | | | Δ0.22 | 800° C. hot calcine |
| $\times 10^6$ Kcal/t - Zn | | | | | | |
| Substantial consumption of energy | 9.6 | 11.1 | 10.1 | 11.1 | 7.9 | |

What is claimed is:

1. A method of recovering metallic zinc by smelting zinc calcine which contains Fe, $SiO_2$ and Au, Ag, and Cu as impurities and in which the ratio of $Fe/SiO_2$ is from about 1 to 3.5, in the presence of a reducing agent, comprising the steps of:

(a) Forming in a smelting furnace a molten bath comprising a slag layer having an $Fe/SiO_2$ ratio close to that of said zinc calcine and a crude lead layer beneath said slag layer;

(b) Introducing into said furnace said zinc calcine, oxygen-enriched air and a reducing agent selected from the group consisting of pulverized coke and pulverized coal in a manner to contact and mix with said molten bath;

(c) Simultaneously smelting the components of steps a and b so charged to the furnace to produce an effluent gas of zinc vapor, CO, $CO_2$ and $N_2$ and to capture in said crude lead layer gold, silver and copper present in small amounts in the zinc calcine;

(d) Passing the effluent gas from the smelting step to a condenser disposed in close proximity to said smelting furnace and providing therein a spray of molten lead or zinc to condense said zinc vapor contained in said effluent gas from said smelting furnace;

(e) separating and recovering from said condensing step metallic zinc and an exhaust gas of high calorie content; and (f) separating said crude lead layer containing gold, silver, and copper for recovery of same.

2. A method according to claim 1, wherein the surface of said slag layer is covered with lump coke or pulverized coke in sufficient amount to prevent the slag and pulverized coke or coal from flying out into said condenser during smelting.

3. A method according to claim 1, wherein the composition of the slag is adjusted to an FeO/CaO ratio of from about 1.5 to 10 by adding lime.

4. A method according to claim 1 wherein said zinc calcine is produced by roasting and then introduced into said furnace at an elevated temperature.

* * * * *